US012709431B2

(12) United States Patent
Wubneh et al.

(10) Patent No.: US 12,709,431 B2
(45) Date of Patent: Aug. 18, 2026

(54) BAKERY TRAY

(71) Applicant: Drader Manufacturing Industries Ltd., Edmonton (CA)

(72) Inventors: Abiy Wubneh, Edmonton (CA); Jeff McTavish, Edmonton (CA)

(73) Assignee: Drader Manufacturing Industries Ltd., Edmonton (CA)

( * ) Notice: Subject to any disclaimer, the term of this patent is extended or adjusted under 35 U.S.C. 154(b) by 0 days.

(21) Appl. No.: 18/642,689

(22) Filed: Apr. 22, 2024

(65) Prior Publication Data

US 2024/0351735 A1 Oct. 24, 2024

Related U.S. Application Data

(60) Provisional application No. 63/460,891, filed on Apr. 20, 2023.

(51) Int. Cl.

| | |
|---|---|
| ***B65D 21/02*** | (2006.01) |
| ***B65D 1/34*** | (2006.01) |
| ***B65D 19/38*** | (2006.01) |
| ***B65D 71/70*** | (2006.01) |

(52) U.S. Cl.
CPC ..... *B65D 1/34* (2013.01); *B65D 71/70* (2013.01); *B65D 21/0226* (2013.01)

(58) Field of Classification Search
CPC ..... B65D 1/34; B65D 71/70; B65D 21/0226; B65D 21/062; B65D 21/06; B65D 7/26; B65D 11/1833; B65D 19/12; B65D 21/046; B65D 2519/00532; B65D 2519/009; B65D 2519/00641
USPC ..... 206/557; 211/126.2; 294/169, 172
See application file for complete search history.

(56) References Cited

U.S. PATENT DOCUMENTS 2,747,748 A * 5/1956 Barefoot ..... A21C 15/00 294/142
2,956,763 A * 10/1960 Nicholas ..... B65D 19/12 211/195
2,994,463 A * 8/1961 Drader ..... B65D 21/0226 294/169
3,124,254 A * 3/1964 Charles ..... B65D 7/26 294/169
3,146,891 A * 9/1964 Nawman ..... B65D 7/26 206/509
3,172,542 A * 3/1965 Nawman ..... B65D 7/26 206/509

(Continued)

FOREIGN PATENT DOCUMENTS

CA 2459700 A1 * 9/2005 ..... B65D 1/34

OTHER PUBLICATIONS

Canadian Industrial Design Reg. No. 106059, "Bread Carrier", Registered: Aug. 23, 2005.

(Continued)

*Primary Examiner* — Gideon R Weinerth
(74) *Attorney, Agent, or Firm* — Nathan V. Woodruff

(57) ABSTRACT

A molded bakery tray include a tray body that has a top surface, a bottom surface, and a peripheral wall around a perimeter of the tray body. Support ribs on the bottom surface intersect an inner surface of the peripheral wall at intersection points along at least one side of the tray body. The support ribs taper from a nominal width to an intersection width at the intersection points, the intersection width being less than the nominal width.

6 Claims, 8 Drawing Sheets

(56) References Cited

U.S. PATENT DOCUMENTS

| | | | | |
|---|---|---|---|---|
| 3,204,778 | A * | 9/1965 | Nawman | B65D 7/26 211/126.9 |
| 3,219,196 | A * | 11/1965 | Hare | B65D 21/0226 211/126.6 |
| 4,106,625 | A * | 8/1978 | Carroll | B65D 21/046 206/507 |
| 4,270,678 | A * | 6/1981 | Drader | B65D 21/0226 294/169 |
| 7,699,172 | B2 | 4/2010 | McTavish et al. | |

OTHER PUBLICATIONS

Canadian Industrial Design Reg. No. 106060, "Bread Carrier", Registered: Aug. 23, 2005.
Canadian Industrial Design Reg. No. 106061, "Bread Carrier", Registered: Aug. 23, 2005.

* cited by examiner

BAKERY TRAY

TECHNICAL FIELD

This relates to bakery trays, and in particular, bakery trays with collapsible handles.

BACKGROUND

Bakery trays are used to store and transport baked goods. An example of a bakery tray 100 is shown in FIG. 1, extracted from Canadian industrial design reg. no. 106060, owned by Drader Manufacturing Industries Ltd. Bakery tray 100 has a base 102 surrounded by a sidewall 104, and pivoting handles 106, shown in the operative position, that can be pivoted to a stowed position adjacent to the base 102 to reduce the height of tray 100 when tray 100 is empty.

SUMMARY

According to an aspect, there is provided a bakery tray, comprising a tray body having a top surface, a bottom surface, and a peripheral wall around a perimeter of the tray body. Support ribs are provided on the bottom surface, the support ribs intersecting an inner surface of the peripheral wall at intersection points along at least one side of the tray body. The support ribs taper from a nominal width to an intersection width at the intersection points. The intersection width is less than the nominal width.

According to further aspects, the bakery tray may include one or more of the following features, alone or in combination: the bottom surface may have a central section and an edge section that is between the central section and the sidewall along the at least one side of the tray body, the edge section may comprising the intersection points, wherein, in the central section, the support ribs are non-orthogonal and non-parallel to the peripheral wall and define a diamond pattern, and in the edge section, the support ribs are substantially orthogonal to the peripheral wall at the intersection points; the bakery tray may further comprise a support flange that is spaced from and extends parallel to the peripheral wall along the at least one side of the tray body, the support flange intersecting vertices of the diamond pattern; the orthogonal segments may intersect support ribs in the diamond pattern; the support ribs in the diamond pattern may intersect at vertices, the support ribs tapering from the nominal width to the intersection width at the vertices; the bakery tray may further comprise a first handle and a second handle on the top surface of the tray body, the first handle being on a first side edge of the tray body opposite a second side edge of the tray body, and the edge section comprises a first edge section that extends along a front edge between the first side edge and the second side edge and a second edge section that extends along a rear edge opposite the front edge and between the first side edge and the second side edge; and the tray body may comprise a first channel that extends along the first side edge of the tray body, and a second channel that extends along the second side edge of the tray body, wherein structural members are secured within each of the first channel and the second channel.

According to an aspect, there is provided a bakery tray, comprising a tray body having a top surface and a bottom surface; a handle on a top surface of the tray body; a channel that extends along a first side edge of the tray body, the channel being defined by an inner flange and an outer flange that is parallel to and spaced from the inner flange toward an outer edge of the tray body; a first series of projections carried by the inner flange that extend into the channel toward the outer flange; a second series of projections carried by the outer flange that extend into the channel toward the inner flange, the second series of projections being offset from the first series of projections along a length of the channel; and a structural member inserted into the channel between the first series of projections and the second series of projections, the first series of projections and the second series of projections being sized to maintain a position of the structural member within the channel.

According to other aspects, the structural member may spaced from the inner channel and the outer channel within the channel by the first series of projections and the second series of projections; at each of a first end and a second end of the channel, the channel and the structural member may each comprise apertures that are aligned and are sized to receive an engagement end of the handle; adjacent to the first end and the second end of the channel, a distance the first series of projections extend into the channel may be decreased and a distance the first series of projections extend into the channel may be increased such that the structural member from a centered position toward the inner flange; and/or the distance the first series of projections and the second series of projections may extend into the channel is varied by causing According to an aspect, there is provided a bakery tray with a locking handle, comprising a tray body having a surrounding wall, the surrounding wall having handle-receiving apertures; a handle having a first end and a second end, the handle being pivotable from a collapsed position to an upright position. At each of the first end and the second end: the handle comprises an engagement portion that is pivotally received by a handle-receiving aperture and defining a pivot axis of the handle, the engagement portion being axially moveable within the handle-receiving aperture; and the handle comprises a support portion that extends perpendicular to the engagement portion and that biases the engagement portion into engagement with the handle-receiving aperture. An axial stop is carried by the tray body adjacent to the handle receiving apertures, each axial stop being perpendicularly spaced from the pivot axis of the handle such that the axial stop allows the engagement portion to be released from the handle-receiving aperture when the handle is in the collapsed position, and prevents the engagement portion from being released from the handle-receiving apertures when the handle is in the upright position.

According to further aspects, at each of the first end and the second end of the handle, the surrounding wall further comprises cammed surfaces adjacent to a locking groove that receive the support portion of the handle in the upright position; and/or the handle may be made from a resilient material that biases the engagement portions into engagement with the handle-receiving apertures, the handle further comprises a release mechanism that, when actuated, applies a force to the engagement portions in a direction away from the respective handle-receiving aperture.

In other aspects, the various features described here may be combined in any reasonable combination.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

A bakery tray, generally indicated by reference number 10, will now be described with reference to FIG. 2 through 10.

Figure 1:
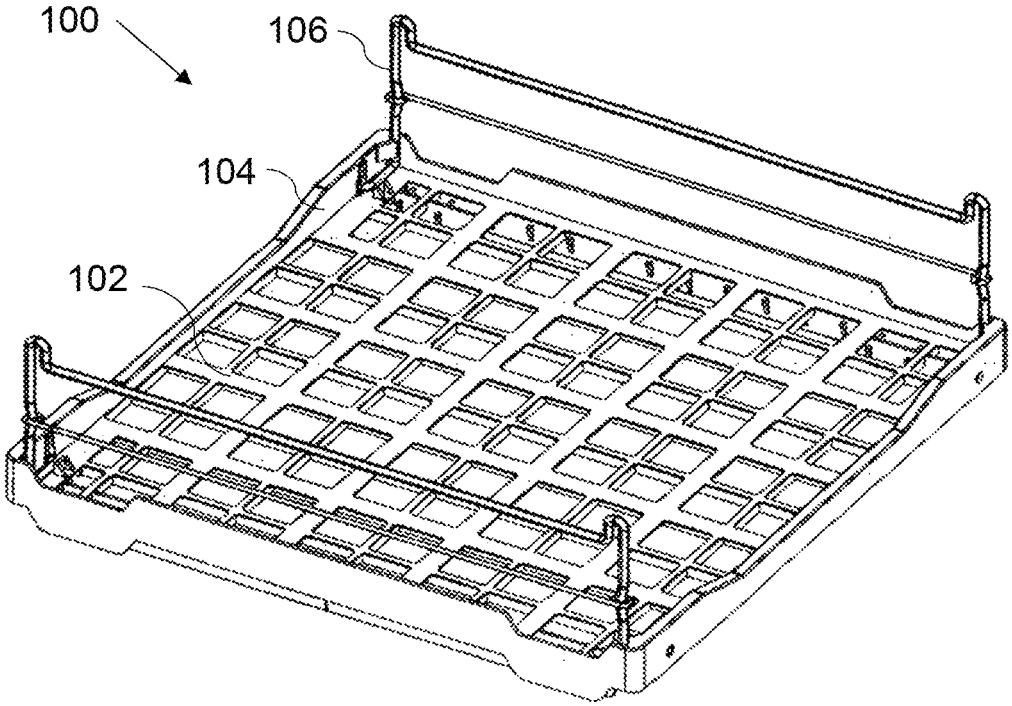
FIG. 1 PRIOR ART
FIG. 1 is a perspective view of a prior art bakery tray.
Figure 2:
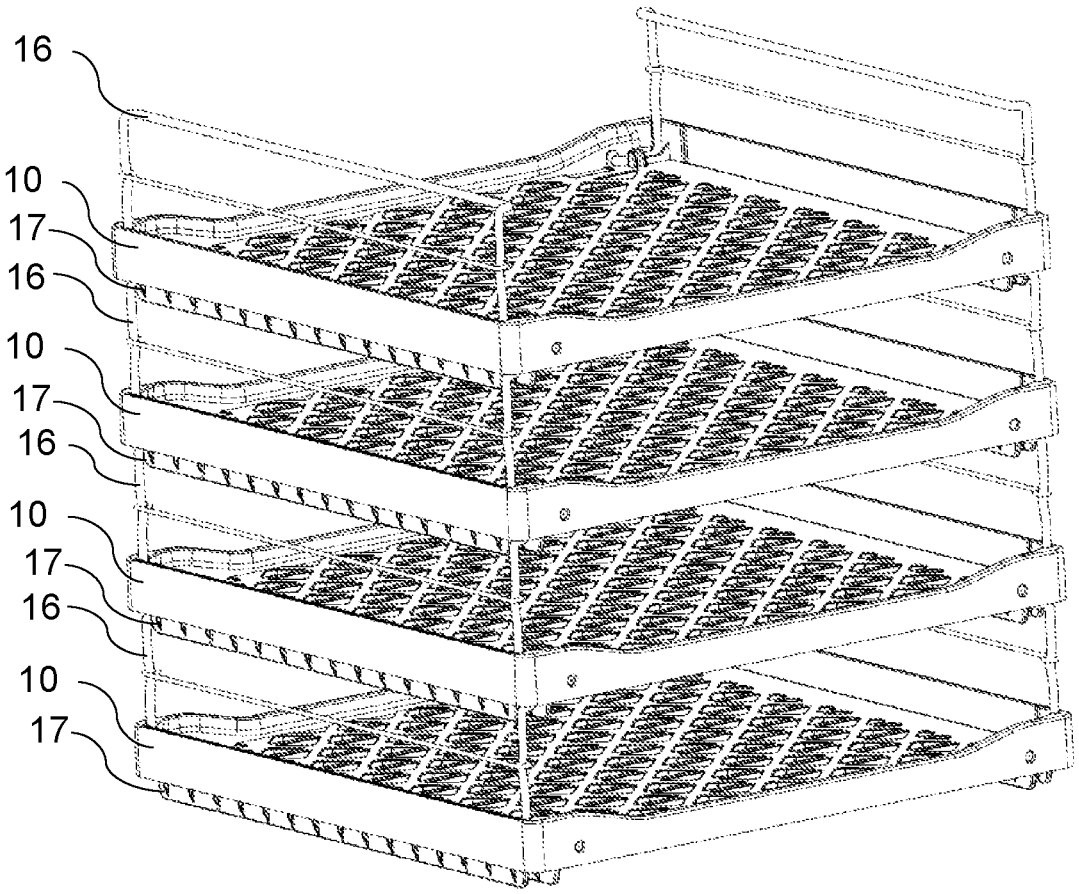
FIG. 2 is a perspective view of a stack of bakery trays.
Figure 3:
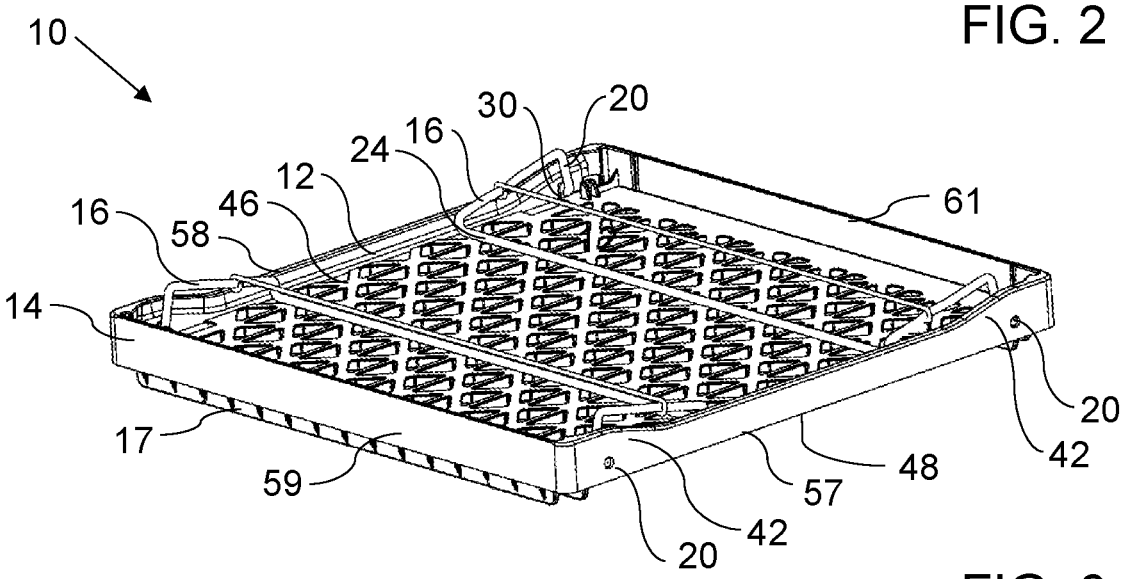
FIG. 3 is a perspective view of a bakery tray with the handles in a stored position.

Referring to FIGS. 2 and 3, bakery tray 10 has a base 12 that is surrounded by a sidewall 14 that allows products, typically bread or other baked goods, to be transported without being damaged. As shown in FIG. 2, bakery trays 10 have handles 16 that are movable between an upright, operative position, in which trays 10 are stackable, and a collapsed, storage position as shown in FIG. 3. In the storage position, handles 16 lie along base 12. Relative to bakery tray 100 shown in FIG. 1, bakery tray 10 may be designed with a larger opening defined between shoulder 42 that permits greater access to the baked goods carried by tray 10. In addition, sidewall 14 may have a chamfered edge to increase the volume of tray 10 and facilitate inserting and removing product by providing an angled surface.

Figure 4:
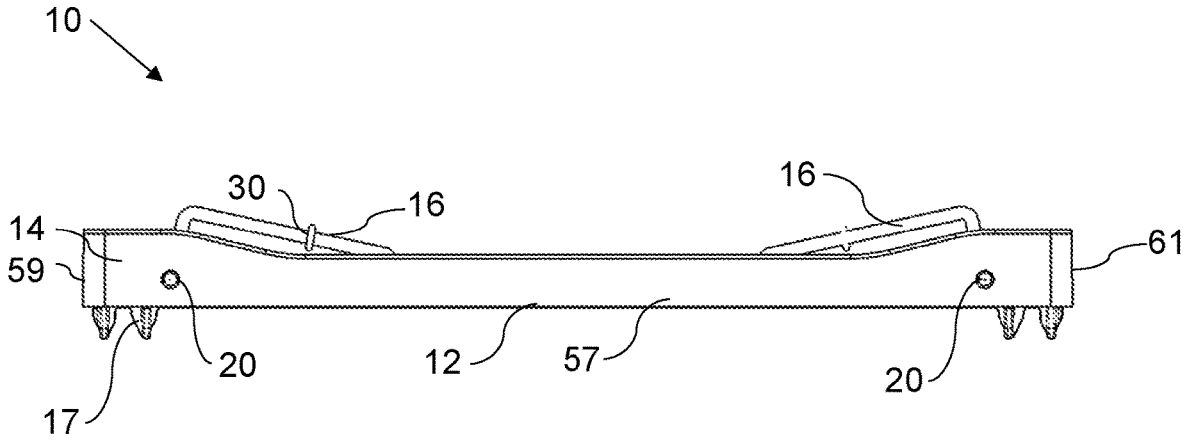
FIG. 4 is an end elevation view of a bakery tray with the handles in a stored position.
Figure 5:
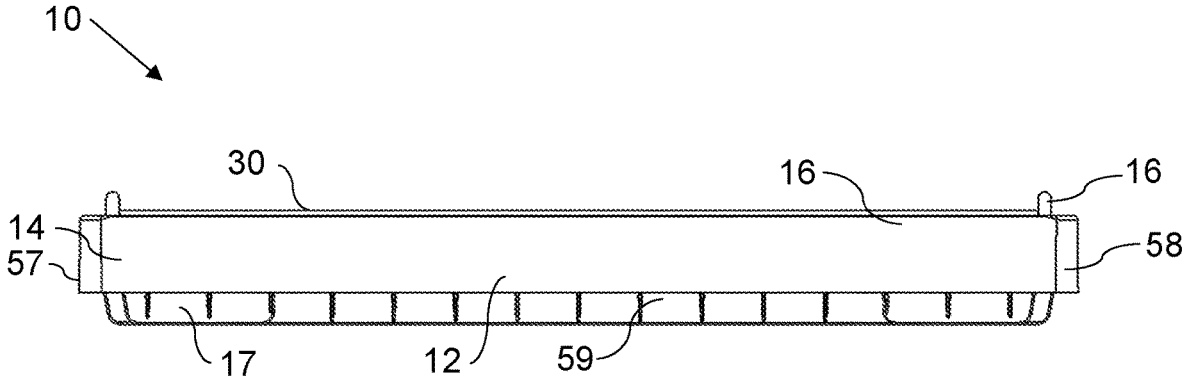
FIG. 5 is a side elevation view of a bakery tray with the handles in a stored position.

Referring to FIGS. 4 and 5, trays 10 may have a profile 17 on the bottom that provide structural support to base, and also create a receiving slot for the handle 16 of an underlying tray 10 to stack trays 10 as shown in FIG. 2.

Figure 6A:
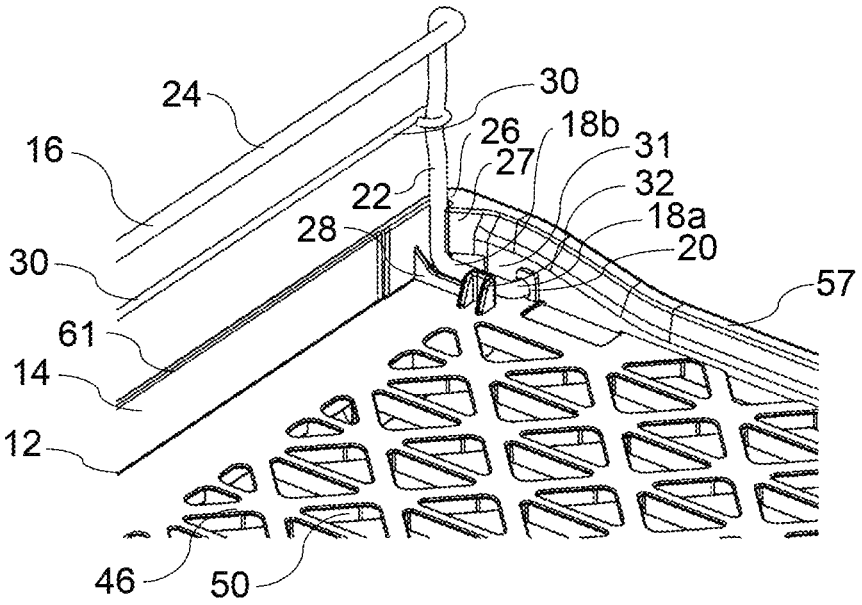
FIG. 6*a* is a detailed perspective view of a bakery tray handle in an upright position.
Figure 6B:
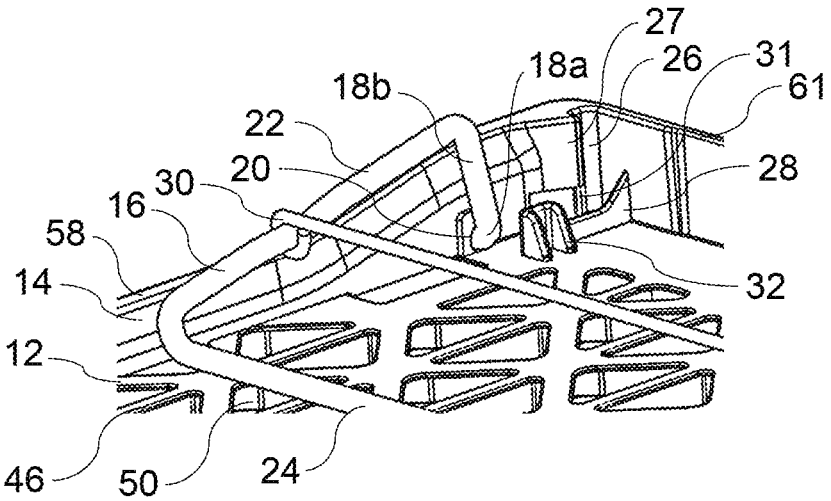
FIG. 6*b* is a detailed perspective view of a bakery tray handle in a stored position.

Referring to FIGS. 6*a* and 6*b*, handles 16 have a tray engagement end 18 that engages the tray and acts as the pivot point, an upright portion 22 that extends substantially perpendicular to the foot portion and that engages a groove 26 that locks handle 16 in the operative position, and a carrying portion 24 that is engaged by the user to carry the trays. Locking groove 26 may be preceded by a cammed surface 27 or ramp that pushes the upright portion inward before relaxing into engagement with the locking groove.

Tray engagement end 18 has a foot 18*a* that engages an aperture 20 in the sidewall 14 of tray 10, and a connecting length 18*b* that extends parallel to base 12 between foot 18*a* and handle 16 when handle 16 is in the upright position as shown in FIG. 6*a*, and extends away from base 12 when handle 16 is in the stored position, as shown in FIG. 6*b*. Handle 16 has a release mechanism 30 that is used to release the upright portion from groove 26, allowing handle 16 to be pivoted to the storage position shown in FIG. 3. As depicted, release mechanism 30 is a cross piece, such as a flexible or resilient metal wire, that extends between upright portions 22 of handle 16 at an intermediate point on handle 16 such that, when pressure is applied between carrying portion 24 and cross piece 30, upright portions 22 closest to base 12 are pulled toward each other and withdrawn from locking groove 26, allowing handles 16 to be pivoted to a storage position.

Base 12 may have a first stop 28, in the form of a flange, that forms a receiving pocket 31 for connecting length 18*b* of foot portion 18*a*. First stop 28 helps secure handle 16 when in the upright position. As a force is applied to upright portions 22, foot 18*a* of tray engagement end 18 may withdraw a certain distance from aperture 20. A second stop 32 may be provided adjacent to foot portion 18*a* to prevent foot portion 18*a* from being unintentionally withdrawn from aperture 20 as handle 16 rotates. The length of foot 18*a* may be sufficient to ensure foot 18*a* remains engaged in aperture 20 as second stop 32 limits the withdrawal of foot 18*a* from aperture 20.

Figure 7:
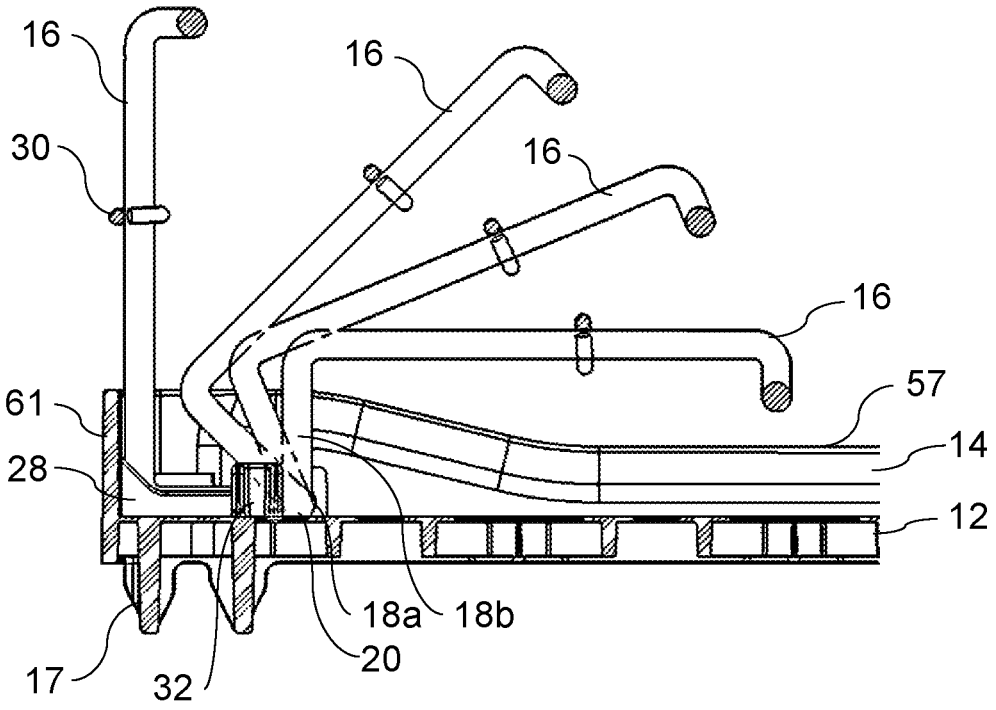
FIG. 7 is a detailed side elevation view of a handle in different positions.

When release mechanism 30 is actuated as discussed above, there is a risk that foot 18*a* foot could be removed from aperture 20, allowing handle 16 to become disengaged from tray 10. Referring to FIG. 7, for ease of assembly and disassembly, second stop 32 may be positioned adjacent to, and misaligned with, aperture 20 and foot 18*a* of handle 16 received therein, which defines the rotational axis of handle 16. In the upright position, second stop 32 prevents foot 18*a* from being withdrawn from aperture 20 when a force is applied to upright portions 22. In the lowered position, the misalignment of second stop 32 from aperture 20 and foot 18*a* permits foot 18*a* of foot portion 18*a* to be withdrawn from aperture 20 without interference from second stop 32. In this manner, second stop 32 only prevents foot 18*a* of handle 16 from being removed when handle 16 is lifted beyond a predetermined angle from the lowered, or storage, position.

In reverse, this action also allows handle 16 to be installed with tray 10. The primary risk of inadvertently removing handle 16 is when handle 16 is being squeezed to engage or disengage handle from locking groove 26. This is more likely to occur when handle 16 is in the upright position, or approaching the upright position, at which point the user is able to properly grip and apply a force to handle 16 and release mechanism 30, the limited size and position of first stop 28 balances facilitating the installation and removal of handle 16 intentionally, with the risk of inadvertently removing handle 16 during normal use.

Referring to FIG. 2, base 12 of bakery tray 10 includes a vented design that allows airflow between and through trays 10 and reduces the weight of each tray 10.

Figure 8:
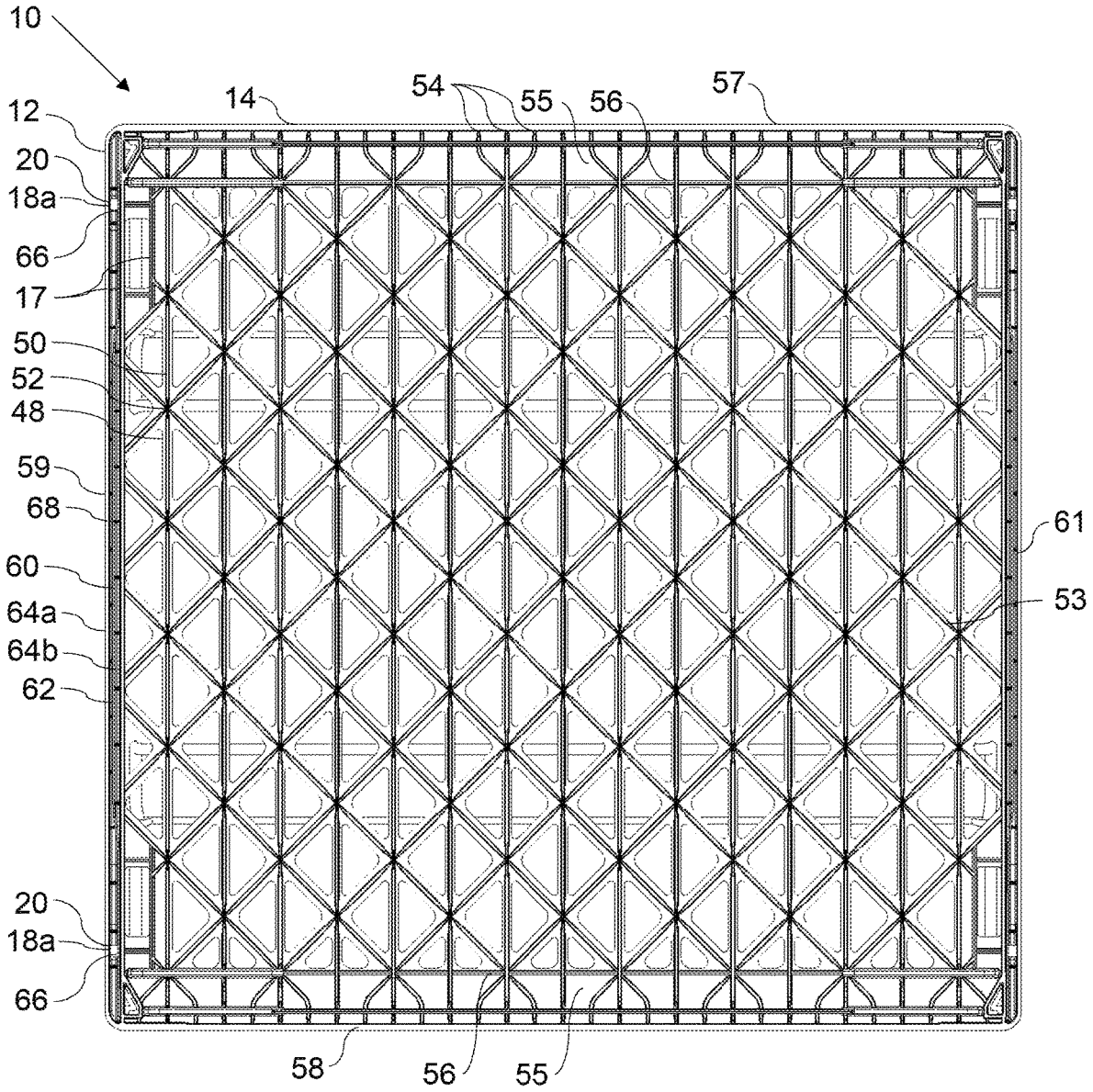
FIG. 8 is a bottom plan view of a bakery tray.

Referring to FIG. 6*a*, the top surface 46 of base 12 is generally flat, while, referring to FIG. 8, the bottom surface 48 may include structural ribs 50 to strengthen base 12 and tray 10. Structural ribs 50 may be designed to reduce warping during manufacturing, and when heated. In particular, if base 12 and surrounding sidewall 14 are made from molded plastic, structural ribs 50 may be shaped to reduce the likelihood of dimpling or sink marks on the outer, visible surface. In doing so, the tray presents more consistent, flat surfaces, which make it easer to imprint with logos, indicia, and the like.

Surface Sink Marks

Figure 9:
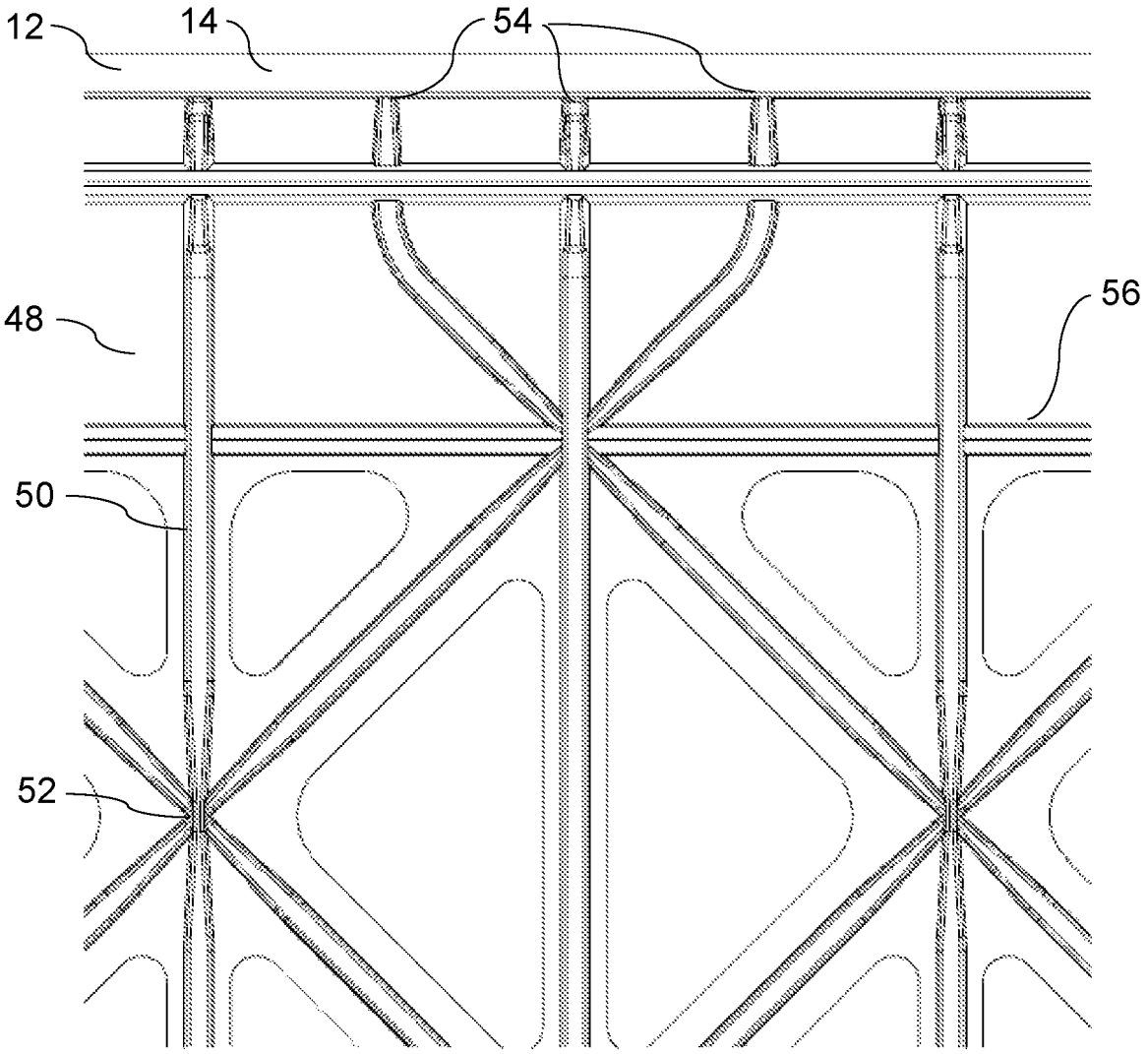
FIG. 9 is a detailed bottom plan view of an end edge of the bakery tray.

Referring to FIG. 9, some options to reduce or eliminate sink marks are shown. In one example, the ratio of the thicknesses of ribs 50 to sidewall 14 may be kept under 0.6. However, reducing the thickness of ribs 50 will affect the strength of base 12, and should be kept sufficiently thick to achieve a desired load-bearing capacity for tray 10. In addition, or alternatively, as shown, ribs 50 may have a constant thickness for a substantial portion of the length, and may taper toward an intersection 52 of ribs 50, which occur at the vertices of the diamond or triangular sections of the tray base. Ribs 50 may also taper toward an intersection 54 with sidewall 14. As dimpling is a result of excess molten plastic that retracts when cooled, the narrowed ribs reduce the amount of plastic at intersections 52 and 54 and therefore reduce the risk or amount of dimpling that occurs.

With respect to intersections 54, to compensate for the loss of strength caused by reducing the cross-sectional area of ribs 50 as a result of the taper, the number of ribs 50 joining sidewall 14 may be increased, such as by using a 'fork' design, in which ribs 50 are angled about 45 degrees to the diamond pattern, and curve as they approach sidewall 14 such that they are substantially perpendicular to sidewall 14, rather than intersecting at an angle as would otherwise be the case with the depicted pattern. The curve may be a discrete corner or a continuous curve as shown, but is generally connected to ribs 50 that form the diamond pattern. In general, for stability and manufacturing, a continuous curve may be preferred.

To further improve the stability and strength of tray 10, a strengthening flange 56 may be provided that is parallel to, and spaced from, front and rear edges 57 and 58 of base 12. In the depicted example, strengthening flange 56 intersects and passes through ribs 50 at the vertices of the diamond pattern. Strengthening flange 56 may be considered to separate a central section 53 of base 12 from peripheral sections 55 that are adjacent to front and rear edges 57 and 58.

As used herein, the front and rear edges 57 and 58 of base 12 correspond with the sides of tray 10 through which product is accessed, and extend between side edges 59 and 61, which extend parallel to handles 16. The labels applied to a given side of base 12 is for convenience.

Structural Member

Figure 10:
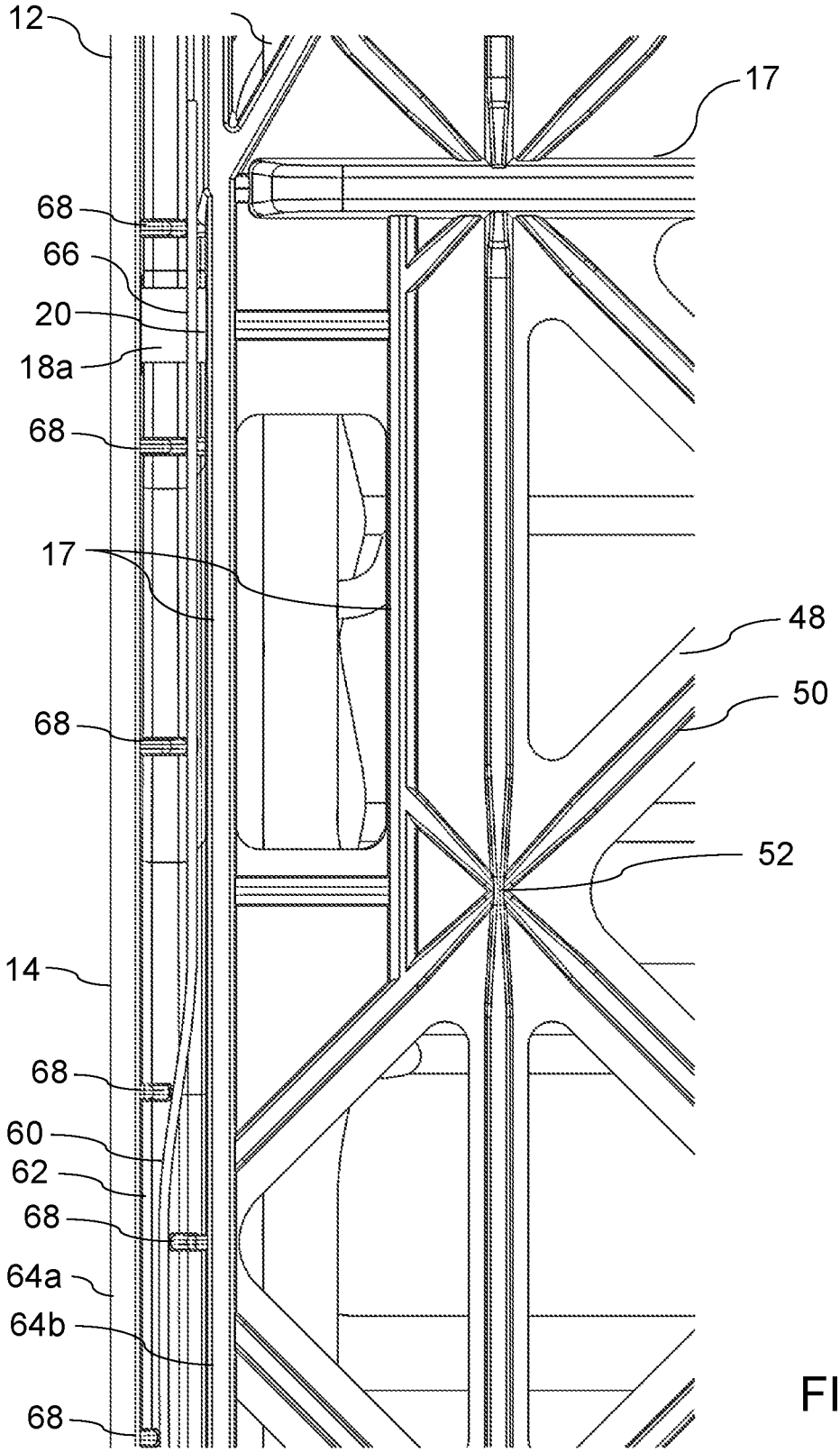
FIG. 10 is a detailed bottom plan view of a side edge of the bakery tray.

Referring to FIG. 10, tray 10 may be provided with a structural member 60 embedded along side edges 59 and 61 of base 12 to provide additional strength. As shown, base 12 is strengthened by structural members 60 along side edges 59 and 61 and strengthening flange 56 and 'fork' design along front and rear edges 57 and 58. As can be seen, the diamond structure and corresponding intersections intersect with the side edges 59 and 61 in light of structural member 60, such that ribs 50 may not be perpendicular to side edges 59 and 61 at the point of intersection. The particular use and disposition of the strengthening structures discussed herein may be applied in a different manner.

As shown, structural member 60 is inserted into a channel 62 defined by adjacent, parallel flanges 64*a* and 64*b* and engaged at either end by foot 18*a* of handles 16 (not seen), which extend through apertures 20. Structural member 60 may be an elongate, flat piece of metal, such as high tensile steel, or other suitable material. Referring to FIG. 8, structural member 60 has apertures 66 at either end through which foot 18*a* of handles 16 pass through. Between structural member apertures 66, structural member 60 is engaged by positioning projections 68 that extend out from one parallel flange 64*a* or 64*b* toward the other parallel flange 64*b* or 64*a* to hold structural member 60 substantially centered in channel 62, or slightly off to one side as shown. Positioning projections 68 may be offset, or in other words, extend from parallel flange 64*a* and 64*b* in an alternating manner such that they are staggered within channel 62, and such that the positioning projections 68 from opposed parallel flanges 64*a* and 64*b* are not aligned. By doing so, positioning projections 68 may be made shorter and have a larger space from the parallel flanges 64*a* and 64*b* toward which each positioning projection 68 extends. In this manner, the mold in which the tray is molded (not shown), which is the negative of the tray, is able to have a larger wall thickness adjacent to each projection 68. This may be done to improve the quality and/or predictability of the manufacturing process.

At either end of channel 62, the size of positioning projections 68 varies from those toward the central section of channel 62 are shaped and sized to bias the structural member toward outer parallel flange 64*b* that is farthest from sidewall 14. In so doing, structural member 60 is retained closer to foot 18*a* of handle 16, making it less likely to be withdrawn from structural member 60 as handle 16 pivots between the operative and collapsed position, causing foot 18*a* to move axially relative to apertures 20 and 66. It will be noted that, as structural member 60 is positioned closer to the outside of sidewall 14 than the inner surface of aperture 20, foot 18*a* will withdraw from structural member aperture 66 prior to being fully withdrawn from aperture 20. This may be done, for example, by increasing the size of the ribs in one or both directions. For example, by increasing the size of positioning projection 68 on outer parallel flange 64*b*, the structural member is pressed inward. Alternatively, or in addition, by increasing the size of the rib on inner parallel flange 64*a*, structural member 60 may be bowed outward, such that the end will be biased inward.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context requires that there be one and only one of the elements.

The scope of the following claims should not be limited by the preferred embodiments set forth in the examples above and in the drawings but should be given the broadest interpretation consistent with the description as a whole.

What is claimed is:

1. A bakery tray with a locking handle, comprising:

a tray body having a carrying surface and a surrounding wall that surrounds the carrying surface; and a handle having a first end and a second end that engage the tray body, the handle being pivotable from a collapsed position to an upright position, wherein, at each of the first end and the second end:

the handle comprises an engagement portion that is pivotally received by a handle-receiving aperture in the surrounding wall of the tray body to define a pivot axis of the handle, the engagement portion being axially moveable within the handle-receiving aperture;

the handle comprises a support portion that extends perpendicular to the engagement portion, wherein, with the handle in the collapsed position, the support portion is spaced from the carrying surface, the support portion pivoting toward the carrying surface as the handle pivots to the upright position; and the tray body comprises an axial stop adjacent to the handle receiving aperture, the axial stop being perpendicularly spaced from the pivot axis of the handle such that the axial stop allows the engagement portion to be withdrawn from the handle-receiving aperture when the handle is in the collapsed position, and prevents the engagement portion from being released from the handle-receiving apertures when the handle is in the upright position.

2. The bakery tray of claim 1, wherein, at each of the first end and the second end of the handle, the surrounding wall further comprises a cammed surface adjacent to a locking groove that receives the support portion of the handle in the upright position.

3. The bakery tray of claim 1, wherein the handle is made from a resilient material that biases the engagement portions into engagement with the handle-receiving apertures, the handle further comprises a release mechanism that, when actuated, applies a force to the engagement portions in a direction away from the respective handle-receiving aperture.

4. The bakery tray of claim 3, wherein the handle comprises a handle section that extends between the support portions, and the release mechanism comprises a tension member that extends parallel to the handle, wherein a force applied to the tension member causes the engagement portions to withdraw from the respective handle-receiving aperture.

5. The bakery tray of claim 1, wherein the support portion comprises a vertical section and a lateral section that extends between the engagement portion and the vertical section such that, with the handle in the upright position, the lateral section extends along the carrying surface and the vertical section extends away from the carrying surface.

6. The bakery tray of claim 5, wherein, in the upright position, the lateral section of the support portion engages the axial stop and the vertical section engages a locking profile carried by the surrounding wall.

* * * * *